US005158240A

United States Patent [19]

Ihara et al.

[11] Patent Number: 5,158,240

[45] Date of Patent: Oct. 27, 1992

[54] PULVERIZER

[75] Inventors: Yoshitaka Ihara; Hidemasa Ishikawa; Iwao Ikebuchi; Hisashi Takei, all of Yao; Shigetoshi Kawabata, Kashiwa, all of Japan

[73] Assignee: Kubota Corporation, Osaka, Japan

[21] Appl. No.: 733,301

[22] Filed: Jul. 22, 1991

[30] Foreign Application Priority Data

Jul. 23, 1990 [JP] Japan ..... 2-79114
Jul. 23, 1990 [JP] Japan ..... 2-196700

[51] Int. Cl.[5] ..... B02C 17/16
[52] U.S. Cl. ..... 241/172; 241/57
[58] Field of Search ..... 241/171, 172, 46.17, 241/57; 366/319, 320, 324

[56] References Cited

U.S. PATENT DOCUMENTS 3,350,280 10/1967 West ..... 241/172 X
4,754,934 7/1988 Ikebuchi et al. ..... 241/172 X

FOREIGN PATENT DOCUMENTS 275188 1/1990 German Democratic Rep. ..... 241/172
995868 2/1983 U.S.S.R. ..... 241/172

*Primary Examiner*—Mark Rosenbaum
*Assistant Examiner*—John M. Husar
*Attorney, Agent, or Firm*—Wenderoth, Lind & Ponack

[57] ABSTRACT

A pulverizer has a shell having an inlet port for introducing air and the material to be pulverized into the shell and a discharge port through which the pulverized product is discharged from the shell. The shell is filled with a pulverizing medium such as steel balls. A vertical screw shaft having a screw blade thereon is rotatably mounted in the shell. The screw shaft is hollow and provided at the bottom end thereof with an outlet port. The outlet port is located behind the screw blade with respect to the direction of rotation of the screw shaft. A fluid supply box is provided at the bottom of the screw shaft and extends from the screw shaft to the outer edge of the screw blade. The outlet port is formed in the fluid supply box. A scrape plate protrudes downwards from the bottom end of the screw shaft. Three or more screw blades may be provided.

12 Claims, 6 Drawing Sheets

PULVERIZER

BACKGROUND OF THE INVENTION

This invention relates to a pulverizer for producing powdery or particulate products.

As shown in FIG. 17, a pulverizer of this type has a vertical shell 1 and a hollow screw shaft 2 extending vertically in the shell. The shell 1 is filled with pulverizing medium b such as steel balls. Material a to be pulverized is introduced into the shell 1 from the top end thereof with the screw shaft 2 rotating to pulverize the material by friction between the particles of the material and between the particles of the material and the pulverizing medium b. The powdery product c thus produced is carried out of the shell 1 by an upward flow of carrier fluid d such as air or water passing through the shell 1.

In this type of pulverizer, the means for introducing carrier fluid d into the shell is in the form of an outlet port 3 provided at the bottom of the screw shaft 2. Carrier fluid d may be supplied to the outlet port 3 through the hollow screw shaft 2 as shown in FIG. 17.

Heretofore, the outlet port 3 was either a mere opening formed in the bottom end of the screw shaft 2 as shown in FIG. 16 or a plurality of vertical slits formed in the bottom end of the screw shaft 2 as shown in FIG. 17. In other words, the outlet port was formed in the screw shaft 2.

In this arrangement, since the fluid d reaches only the area near the screw shaft 2, that is, only the central part of the shell 1, an upward current is also formed only in the central part. This causes only the pulverized product c in this area to be discharged, with the product in the outer peripheral part of the shell 1 remaining in the shell for a long time and pulverized too finely. Thus, it was difficult to pulverize the material in the shell uniformly.

Also, since the bottom opening in the screw shaft 2 is liable to get clogged by the pulverizing medium and the material to be pulverized, fluid d has to be fed into the shell 1 with a sufficient force to push them aside. This requires a large amount of power. For example, if the fluid d is air, a fan with a large capacity is required.

Further, if the slits are formed in the screw shaft 2, the number and thus the sectional area thereof cannot be increased so much. Thus, a considerable amount of power is necessary to feed a sufficient amount of fluid.

Also, since the pulverizing medium is always in contact with the bottom end of the screw shaft 2 and the slits, the screw shaft 2 tends to be worn remarkably at the bottom edge thereof or at the area surrounding the slits.

In the pulverizer shown in FIG. 16, the inner diameter of the shell 1, the outer diameter of the screw blades 10 and the revolving speed of the screw shaft 2 are determined taking into consideration the diameter of the pulverizing medium and the inclination of the screw blades. But the screw blades and the liners tend to be worn severely. If the revolving speed is reduced in order to reduce wear of the liners, the efficiency of pulverization will drop.

SUMMARY OF THE INVENTION

It is an object of the present invention to provide a pulverizer which allows a smooth and uniform supply of the carrier fluid into the shell, which can reduce wear at the outlet port and which obviates the abovesaid problems of the prior art.

In order to solve these problems, the pulverizer according to this invention has outlet ports for the carrier fluid provided behind the screw blade, at the bottom of the screw shaft, with respect to the direction of rotation thereof, and fluid supply boxes extend from the screw shaft to the outer periphery of the screw blade. In this case, the above-described outlet ports are formed in the fluid supply boxes. The fluid supply boxes should preferably have an outer peripheral surface extending at an inclination toward the screw shaft and rearwardly with respect to the direction of rotation. Further, it should preferably have a bottom surface tape upwardly and rearwardly with respect to the direction of rotation.

Further, downwardly protruding scrape plates are provided on the bottom of the screw shaft. They should preferably be inclined or skewed rearwardly with respect to the direction of rotation.

In the pulverizer according to this invention, the material is pulverized by turning the screw shaft in the known manner and the pulverized product is discharged out of the shell. During this operation, the pulverizing medium is scraped up by the screw blades, creating air gaps behind the screw blades with respect to the direction of rotation thereof, the gaps extending over the entire length of the screw blade, i.e. from the outer periphery of the screw shaft to that of the screw blade. Since the outlet port for the carrier fluid is located near the air gaps, the fluid is smoothly blown radially in directions from the outlet port in the shell and flows up.

In the arrangement wherein the outlet port for the carrier fluid is formed in the fluid supply box, the fluid supply box serves to feed the carrier fluid more smoothly. The box may have its peripheral surface extending at an inclination with respect to the direction of rotation. This surface, which forms a relief angle with respect to the flow of pulverizing medium, serves to reduce wear of the box.

Also, by the provision of the scrape plates, the pulverizing medium located near and under the screw shaft is scraped together, thus creating an air gap behind each scrape plate with respect to the direction of rotation. The scrape plates should preferably be inclined or skewed rearwards with respect to the direction of rotation so that the pulverizing medium will move outwards. This serves to increase the size of the air gaps near the screw shaft, thus allowing the carrier fluid to be blown out more smoothly into the gaps.

We observed the range within which the pulverizing medium is moved by the screw blades in this type of pulverizer, namely the range within which the pulverizing medium is affected by the turning force of the screw blades when they turn for a predetermined time period. As a natural result, we found that the higher the revolving speed is, the larger the range of influence. This fact suggests that by moving the pulverizing medium in the area outside the range of influence with extra screw blades, the range of influence can be kept large even if the revolving speed is low.

In another arrangement, the screw shaft is provided with an increased number of blades, so that a large number of blades exist in any given horizontal plane. Thus, even if the area of influence of each blade is narrowed as a result of reduction in the revolving speed of the screw shaft, the area of influence of all of the blades covers substantially the entire area in the shell.

Also, we found that the pulverizing medium is in frictional contact with the upper surface of the screw blades. We thought that such friction can be reduced if part of the pulverizing medium can be kept on the upper surface of the blades.

In still another arrangement, ribs are provided to prevent movement of the pulverizing medium on the blades, thus causing it to stay on the blades. As a result, the moving medium is brought into frictional contact with the medium staying on the blades and not directly with the blades. Thus, no large frictional force will act on the blades.

According to this invention, the material can be pulverized uniformly and the pulverized product in the shell throughout the entire area can be smoothly carried out. Since the product can be carried out smoothly, a large amount of power is necessary not to discharge the product. The peripheral surface of the box may extend at an inclination to protect the box and the outlet port against wear.

In another arrangement, wear of the screw blades can be reduced. This improves the durability of the blades and thus reduces the maintenance cost and makes a long continuous operation possible.

BRIEF DESCRIPTION OF THE DRAWINGS

Other features and objects of the present invention will become apparent from the following description taken with reference to the accompanying drawings, in which.

DETAILED DESCRIPTION OF THE PREFERRED EMBODIMENT

EMBODIMENT 1

Figure 1:
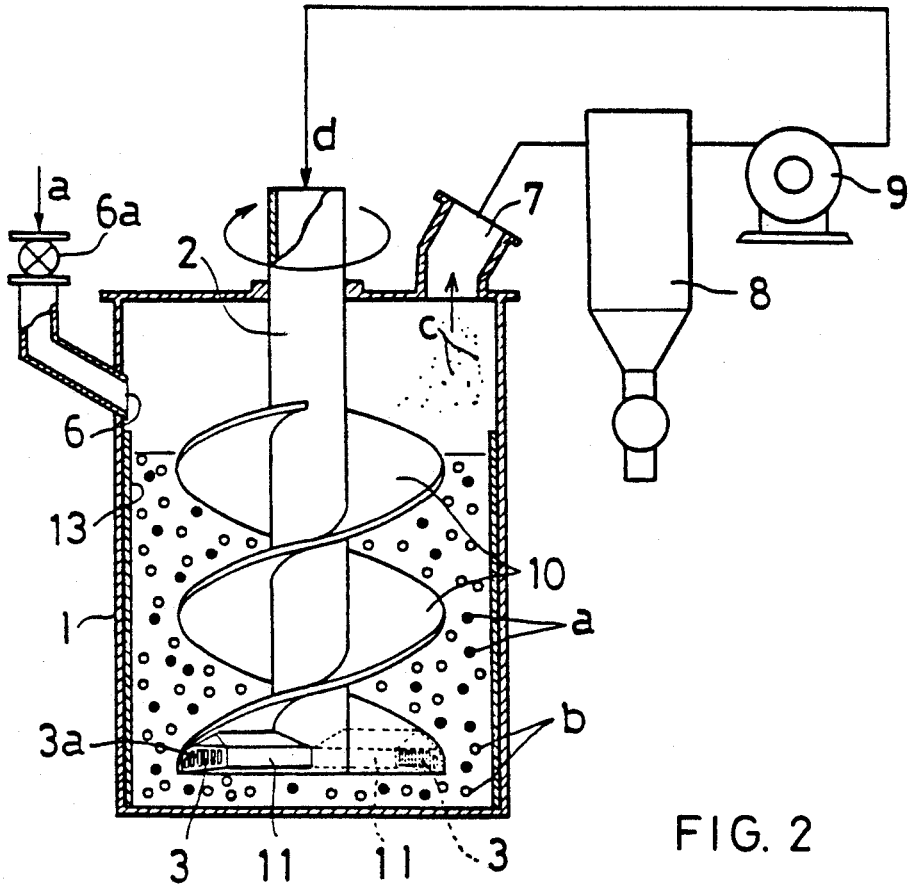
FIG. 1 is a schematic diagram, partly in section, of the first embodiment of the pulverizer according to this invention.
Figure 2:
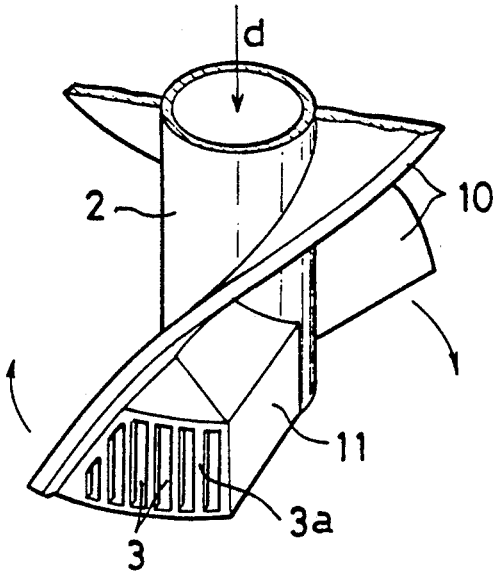
FIGS. 2 and 3 are perspective views of portions of the embodiment of FIG. 1.

As shown in FIG. 1, a pulverizer has a vertical shell 1 and a hollow screw shaft 2 rotatably mounted in the shell. The shell 1 is filled with pulverizing medium b such as steel balls. Material a to be pulverized is introduced into the shell 1 from its top end with the screw shaft rotating to pulverize the material by friction between the particles of the material and between the particles of the material and the medium b. The powdery product c thus produced is carried out of the shell 1 by an upward flow of carrier fluid d such as air or water passing through the shell 1.

First, as shown in FIG. 1, an inlet port 6 for the material a to be pulverized and a discharge port 7 for the pulverized product c are provided at the upper part of the shell 1. A rotary valve 6*a* is provided in the inlet port 6 to feed the material a into the shell 1 while keeping air-tightness. The discharge port 7 is connected to a suction fan 9 through a product collector 8 such as a bag filter or a cyclone. The fan 9 serves to circulate air through the hollow screw shaft 2, shell 1 and a collector 8.

Figure 3:
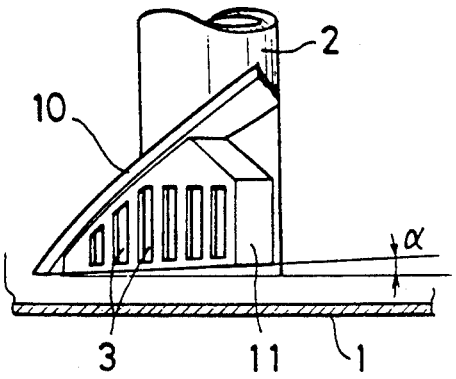
Figure 4:
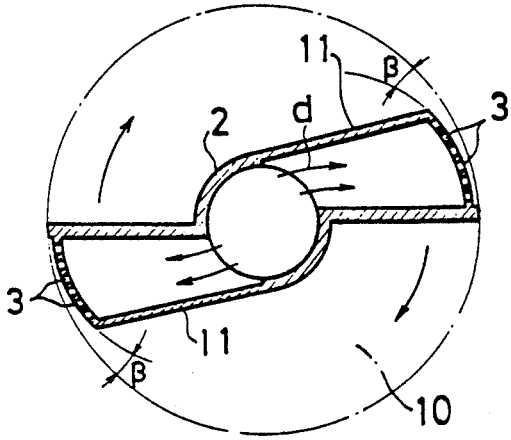
FIG. 4 is a cross-sectional view of a screw shaft of the pulverizer shown in FIG. 1.
Figure 5:
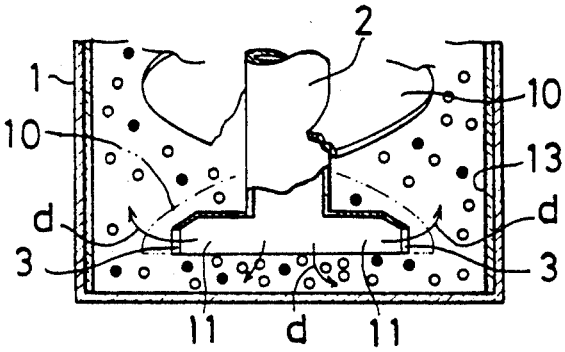
FIG. 5 is a sectional view of a portion of the embodiment of FIG. 1 showing how it operates.

Air supply boxes 11 are provided at the bottom end of the screw shaft 2 so as to extend from the shaft 2 to the outer edge of a screw blade 10 formed on the shaft. Each box 11 has an outlet port 3 in the form of slits defined by a grid 3*a* to prevent an inflow of the pulverizing medium b. The number, shape and size of the slits should be determined according to the desired flow rate of fluid (air). The end surfaces of the air supply boxes 11 extending along the outer periphery of the blade 10 and their bottom surfaces are inclined rearwardly with respect to the direction of rotation as shown in FIGS. 3 and 4, forming relief angles $\alpha$ and $\beta$, respectively, which serve to lessen friction between the boxes 11 and the pulverizing medium b. The relief angles $\alpha$ and $\beta$ are determined through experiments taking into account the degree of friction. In the figures, numeral 13 designates a liner laminated on the inner surface of the shell 1.

When the fan 9 is activated, a circulating flow of air (fluid) is formed. By turning the screw shaft 2 in this state, the material is pulverized in the shell 1 into the product c in the conventional manner. The product c thus pulverized is carried up by an upward current of air out of the shell 1 and is collected in the collector 8.

While the material is being pulverized, the pulverizing medium b is scraped up by the screw blade 10, so that air gaps are formed behind the screw blade. Air d is blown out of the shaft 2 into the air gaps and flows up uniformly over the entire periphery in the shell. The product can be smoothly carried out by this upward air current.

EMBODIMENT 2

Figure 6:
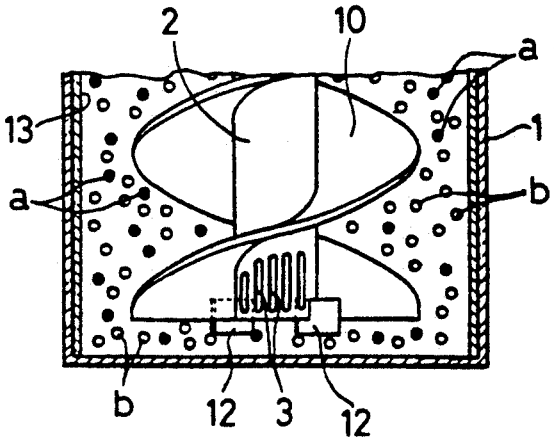
FIG. 6 is a schematic diagram, partly in section, of a portion of the second embodiment.

In this embodiment shown in FIG. 6, scrape plates 12 are used to blow out air d smoothly.

Such scrape plates 12 are provided at the bottom end of the screw shaft 2. They extend downwardly from the bottom of the shaft 2 and are inclined or skewed rearwardly with respect to the direction of rotation and are disposed partially inside the shaft 2. The number, position and the extent of the downward protrusion of the scrape plates are determined according to the scraping requirement.

Figure 7:
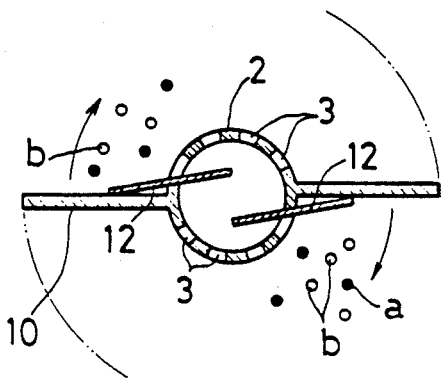
FIG. 7 is a cross-sectional view of a screw shaft of the pulverizer shown in FIG. 6.
Figure 8:
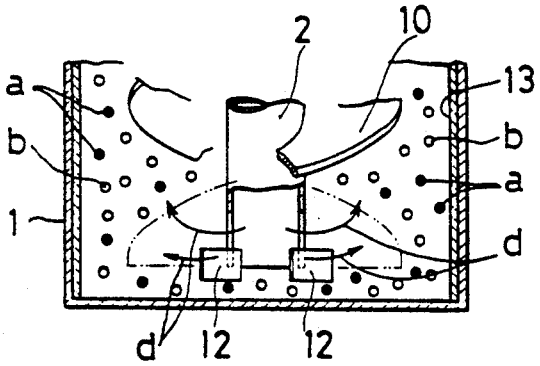
FIG. 8 is a sectional view of a portion of the embodiment of FIG. 6 showing how it operates.

As the screw shaft 2 rotates, the pulverizing medium b near and under the screw shaft 2 will be pushed outwardly by the scrape plates 12. Thus air gaps are formed behind the scrape plates 12 with respect to the direction of rotation. The air d is blown smoothly into the air gaps and flows up in the shell 1. Also, since the scrape plates 12 partially extend into the screw shaft 2 as shown in FIG. 7, the material in the screw shaft 2 can be pushed out of the outlet port 3, forming an air gap in the screw shaft 2. Thus, air flows out smoothly.

Figure 9:
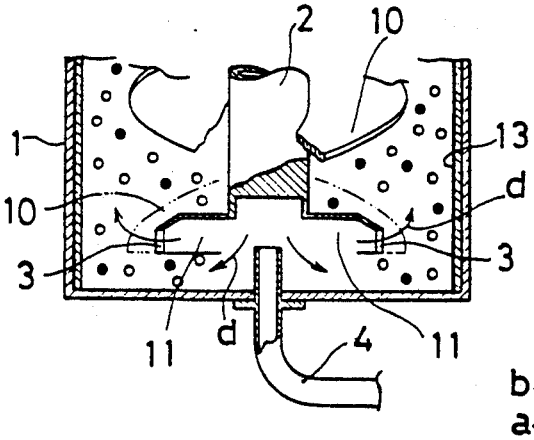
FIGS. 9 and 10 are sectional views of portions of other embodiments.
Figure 10:
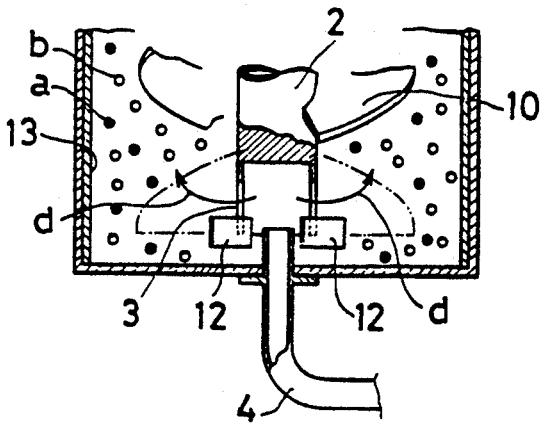

In either of the first and second embodiments, fluid d may be supplied through a separate pipe 4 as shown in FIGS. 9 and 10. The scrape plates 12 of the second embodiment may be added to the structure of the first embodiment e.g. at the bottom of the screw shaft 2. Further, the carrier fluid d may be a gas other than air or a liquid such as water.

EMBODIMENT 3

Figure 11:
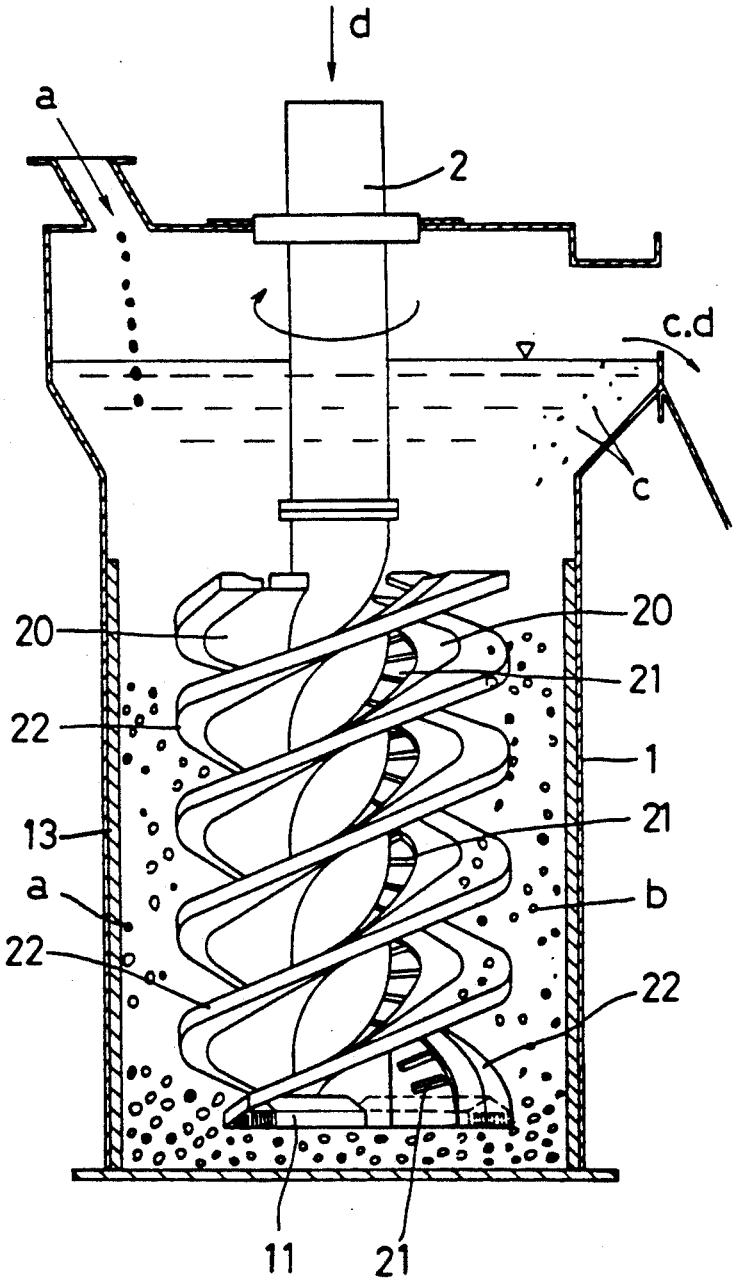
FIG. 11 is a schematic diagram, partly in section, of a third embodiment.
Figure 12:
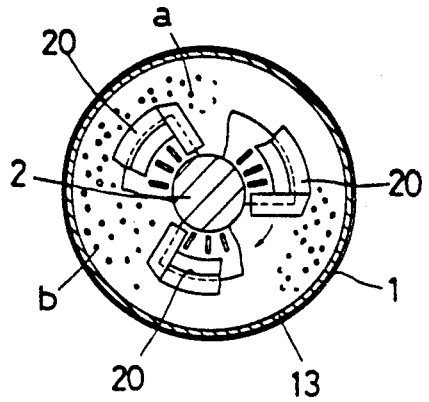
FIG. 12 is a cross-sectional view, partially cut away, of a screw shaft of the pulverizer shown in FIG. 11.

In this embodiment, the screw shaft 2 is provided with three screw blades 20 as shown in FIGS. 11 and 12. As shown in FIG. 12, the blades 20 are arranged at equal angular intervals as viewed from top. The horizontal component of the counterforce from the pulverizing medium b acts uniformly on the blades 20, allowing the screw shaft 2 to rotate smoothly in good balance.

Figure 13:
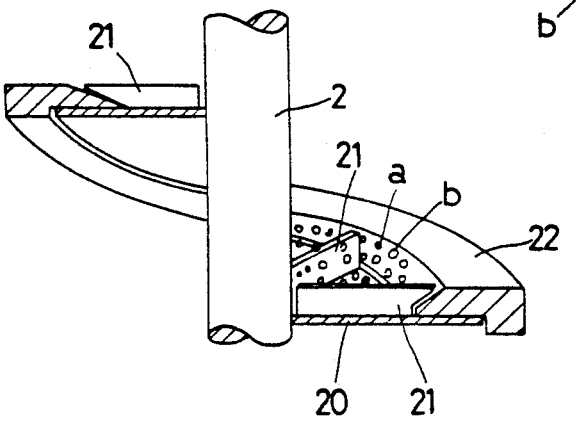
FIG. 13 is an enlarged perspective view of a portion of the screw shaft shown in FIG. 11.

As shown in FIG. 13, ribs 21 in the form of thin plates may be welded to the upper surface of the blades 20. A liner 22 is bolted to each blade 20 to extend along the entire edge thereof. The height and intervals of the ribs 21 should be determined according to the diameter and the desired degree of staying of the pulverizing medium.

Figure 14:
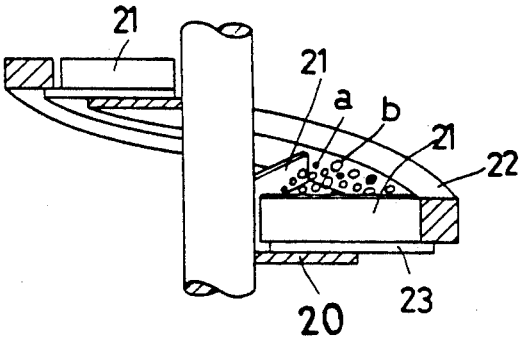
FIG. 14 is an enlarged perspective view of a portion of a still further embodiment of a screw shaft.

The liner 22 and the ribs 21 may be mounted on the blades 20 by fixing them first to a sub-board 23 and then welding or bolting the sub-board 23 to the blades 20 as shown in FIG. 14. In FIG. 11, numeral 13 designates a liner laminated on the inner surface of the shell 1.

Figure 15:
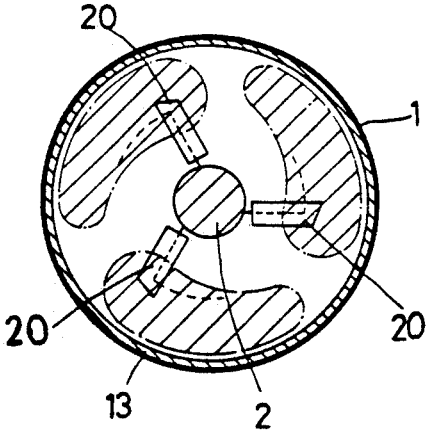
FIG. 15 is a schematic cross-sectional diagram of the screw shaft of the embodiment of FIG. 11 showing the area of influence of the pulverizing material and FIGS. 16 and 17 are, respectively, a sectional view of a portion of a pulverizer and a schematic diagram, partly in section, thereof.
Figure 16:
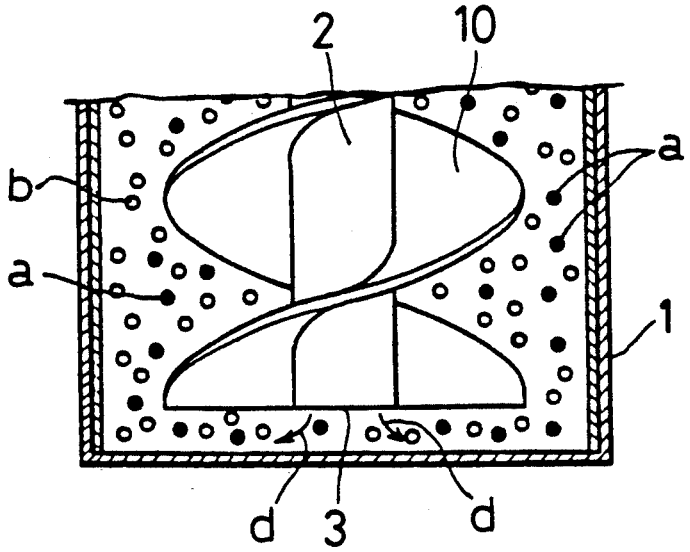
FIG. 16 PRIOR ART
Figure 17:
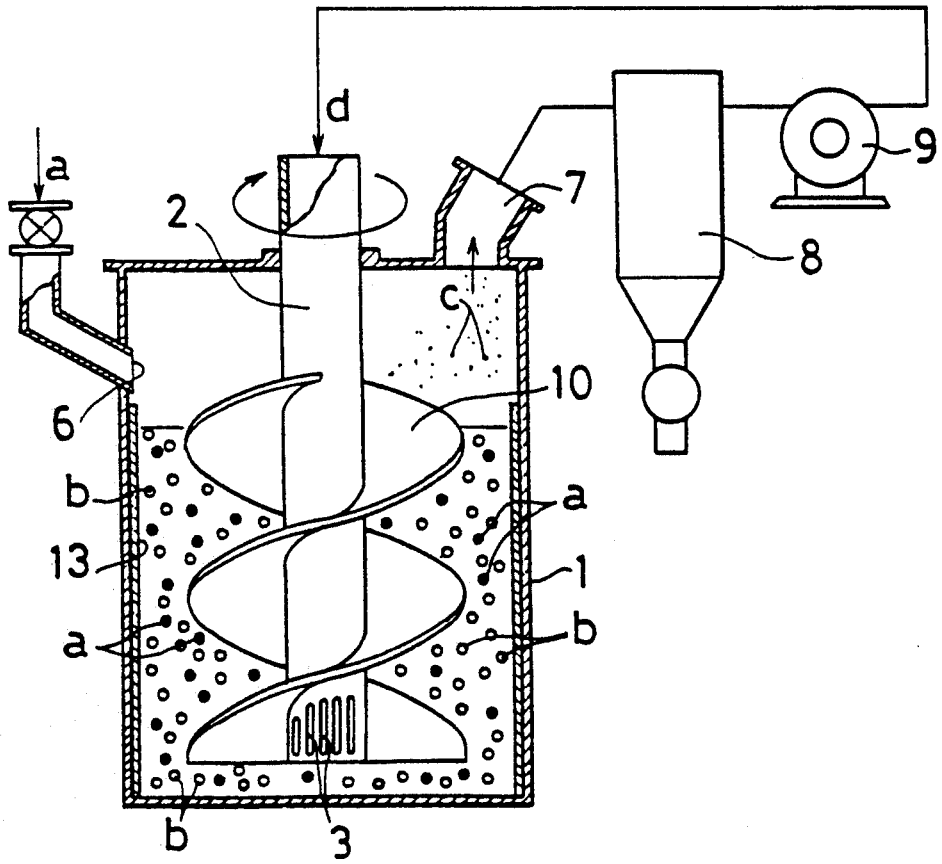
FIG. 17 PRIOR ART

In operation, as shown in FIG. 15, since there are provided three blades 20 on the shaft 2, even if the turning speed of the screw shaft 2 is low, the influence of the blades 20 covers substantially the entire area in the shell 1. This allows smooth pulverization in the shell. Namely, the pulverizing efficiency scarcely drops even if the turning speed is low.

Generally, as the turning speed of the screw shaft increases, the blades 20 wears at a rate higher than the increase in the rate of the turning speed. By increasing the number of blades 20, the total area of wearing surfaces increases. Therefore, the turning speed can be reduced. This leads to reduction in wear as a whole, thus allowing a prolonged continuous operation compared with a conventional structure.

The ribs 21 serve to prevent movement of the pulverizing medium on the blades 20, so that the medium will stay longer on the blades. Thus, the moving medium is brought into frictional contact with the medium staying on the blades. Thus, the frictional force from the pulverizing medium scarcely acts on the upper surface of the blades 20. Namely, the pulverizing medium staying on the blades acts as a lining for the blades. This reduces wear of the blades 20, thus allowing a prolonged continuous operation.

In this embodiment, three blades 20 are provided. But four or more blades will also provide a similar effect. In any case, the blades should be arranged at equal intervals as viewed from top.

What is claimed is:

1. A pulverizer comprising: a vertically extending shell having an inlet port for introducing material to be pulverized into the shell and a discharge port through which pulverized product is to be discharged from the shell; said shell being filled with a pulverizing medium; a hollow screw shaft extending vertically in said shell and rotatably supported in the pulverizer; a screw blade extending around said screw shaft, said screw blade having an outer terminal edge; and a fluid supply box provided at bottom of said screw shaft, said fluid supply box extending from said screw shaft to the outer terminal edge of said screw blade and having an outer peripheral wall extending at said outer terminal edge of the screw blade, and said fluid supply box defining an outlet port in said outer peripheral wall thereof and communicating with the interior of said hollow screw shaft such that air forced through said hollow screw shaft is discharged from the outlet port of the fluid supply box at the outer terminal edge of the bottom of the screw blade, whereby the air will be distributed uniformly at the periphery of the shell.

2. A pulverizer as claimed in claim 1, wherein said outer peripheral wall extends rearwardly in a direction from the outer terminal edge of said screw blade and toward said screw shaft at an inclination with respect to the direction in which said screw shaft is to rotate in the shell.

3. A pulverizer as claimed in claim 2, and further comprising at least two other screw blades extending around said screw shaft.

4. A pulverizer as claimed in claim 3, and further comprising ribs provided on the upper surface of each of said screw blades at equal intervals in the longitudinal direction of said screw blades, respectively, and a respective liner extending along the entirety of each of the outer terminal edges of said screw blades, each of said ribs extending radially from said screw shaft to a respective one of the liners such that a plurality of pockets containing said pulverizing medium are respectively defined between said screw shaft, adjacent ones of said ribs on a respective said screw blade, and the liner on said respective screw blade.

5. A pulverizer as claimed in claim 2, and further comprising a scrape plate protruding downwards from the bottom end of said screw shaft and extending substantially diametrically of said screw shaft.

6. A pulverizer as claimed in claim 1, wherein said fluid supply box has a bottom wall extending in a direction upwardly and rearwardly from said screw blade at an inclination with respect to the direction in which the screw shaft is to rotate in the shell.

7. A pulverizer as claimed in claim 6, and further comprising at least two other screw blades extending around said screw shaft.

8. A pulverizer as claimed in claim 7, and further comprising ribs provided on the upper surface of each of said screw blades at equal intervals in the longitudinal direction of said screw blades, respectively, and a respective liner extending along the entirety of each of the outer terminal edges of said screw blades, each of said ribs extending radially from said screw shaft to a respective one of the liners such that a plurality of pockets containing said pulverizing medium are respectively defined between said screw shaft, adjacent ones of said ribs on a respective said screw blade, and the liner on said respective screw blade.

9. A pulverizer as claimed in claim 6, and further comprising a scrape plate protruding downwards from the bottom end of said screw shaft and extending substantially diametrically of said screw shaft.

10. A pulverizer as claimed in claim 1 and further comprising a scrape plate protruding downwards from the bottom end of said screw shaft and extending substantially diametrically of said screw shaft.

11. A pulverizer as claimed in claim 1, and further comprising at least two other screw blades extending around said screw shaft.

12. A pulverizer as claimed in claim 11, and further comprising ribs provided on the upper surface of each of said screw blades at equal intervals in the longitudinal direction of said screw blades, respectively, and a respective liner extending along the entirety of each of the outer terminal edges of said screw blades, each of said ribs extending radially from said screw shaft to a respective one of the liners such that a plurality of pockets containing said pulverizing medium are respectively defined between said screw shaft, adjacent ones of said ribs on a respective said screw blade, and the liner on said respective screw blade.

* * * * *